United States Patent [19]

Vazquez

[11] 4,303,145

[45] Dec. 1, 1981

[54] LADDER, PLATFORM & EXTENSION

[76] Inventor: Roberto Vazquez, 4737 Cole St., West Palm Beach, Fla. 33409

[21] Appl. No.: 147,849

[22] Filed: May 8, 1980

[51] Int. Cl.[3] ..... E06C 7/16; E06C 7/14

[52] U.S. Cl. ..... 182/122; 182/20; 182/106; 248/238

[58] Field of Search ..... 182/122, 121, 106, 117, 182/20; 248/210, 211, 238

[56] References Cited

U.S. PATENT DOCUMENTS

| | | | |
|---|---|---|---|
| 1,452,182 | 4/1923 | Butrum | 182/121 |
| 1,501,298 | 7/1924 | Armitage | 182/117 |
| 1,920,552 | 8/1933 | Dollerhide | 182/121 |
| 2,766,957 | 10/1956 | Nelson | 248/211 |
| 2,837,260 | 6/1958 | Kinnett | 182/122 |
| 2,906,485 | 9/1959 | Dakin | 248/238 |

*Primary Examiner*—Reinaldo P. Machado
*Attorney, Agent, or Firm*—Malin & Haley

[57] ABSTRACT

A dual purpose ladder attachment usable singularly as a human body support platform with hand rails or in a pair as a scaffold jack. Each ladder attachment comprises two pairs of pivotally joined support beams. Each pair of pivotally joined support beams have their non-joined ends connected to ladder rung engaging brackets. Each bracket is sized and shaped to fit over the side rail of the ladder while engaged with a ladder rung. When the device is being used as a body support platform, a cross-bar connected between the parallel support beams supports a rigid planar surface which is also attached to a ladder rung. This platform is useful for standing on the ladder while holding the side rails. In this configuration the device is mounted to extend vertically upward on the upper side of the ladder, allowing a user to stand comfortably on the ladder. When the device is being used as a scaffold jack, the cross-bar and standing platform are removed and the ladder attachment is inverted and placed on the under side of the ladder in such a manner as to support one end of the scaffold board.

1 Claim, 9 Drawing Figures

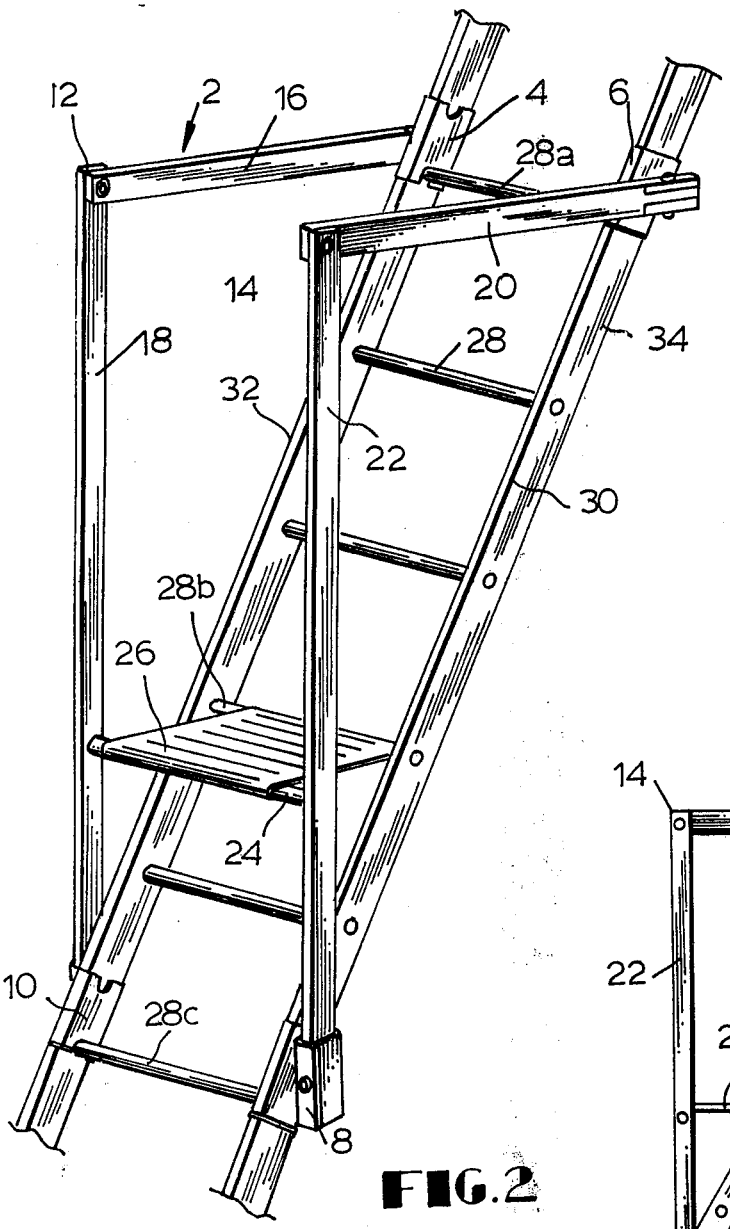
FIG. 2
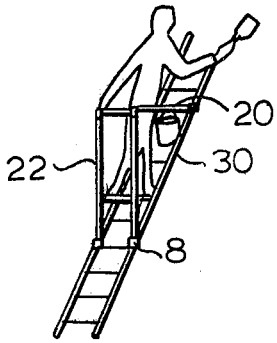
FIG. 1
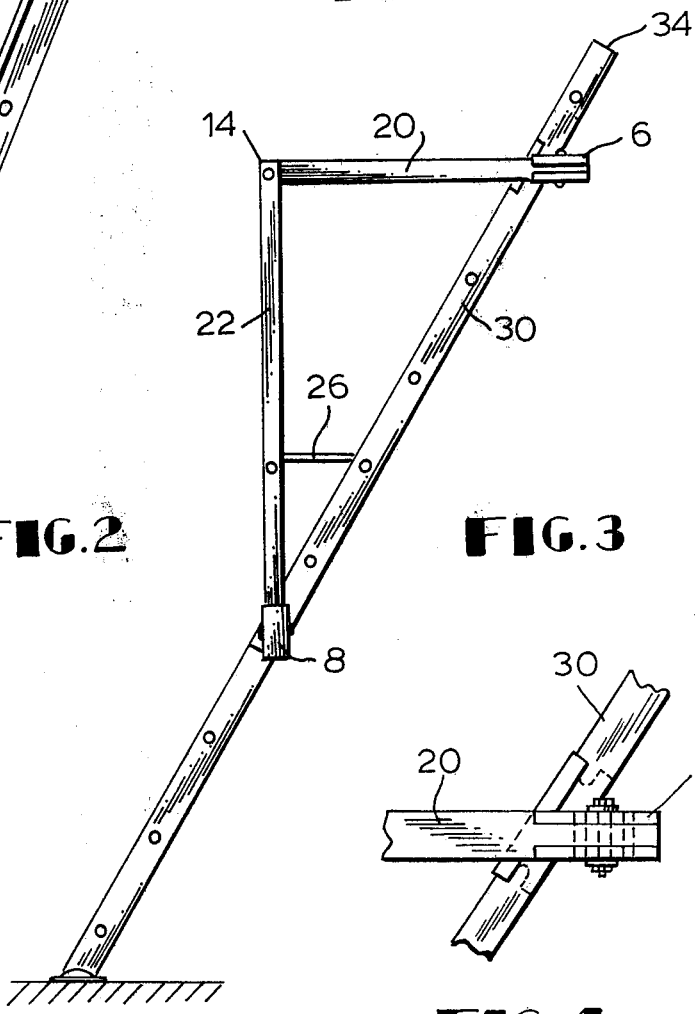
FIG. 3
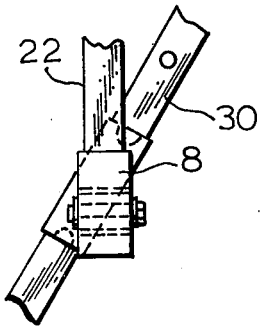
FIG. 5
FIG. 4

LADDER, PLATFORM & EXTENSION

BACKGROUND OF THE INVENTION

The present invention relates to ladder attachments and more particularly to a multi-purpose ladder attachment which can be used as a ladder platform or a scaffold jack.

In the past, there have been various types of ladder attachments for supporting both humans and articles. By way of example is U.S. Pat. No. 2,837,260 in which a safety device for a ladder is illustrated. This includes vertical support members and horizontal support members attached to the rails of the ladder by guide brackets and also includes a foot plate towards the lower end of the vertical support member which is attached to a ladder rung and the two vertical support members. However, this device is not readily adaptable to be attached to the underside of the ladder when scaffolds are necessary.

Another example is shown in U.S. Pat. No. 606,763 which illustrates a scaffold support. Although the scaffold support can also be used as a platform, it lacks the structure to provide holding rails for a person standing on the platform.

The present invention overcomes the problems associated with devices shown in the prior art by eliminating structural limitations which diminished the utility of the prior art devices. With the present invention, a single device can be utilized to provide either a safe, singular platform for standing on a ladder for prolonged work periods or as a scaffold support when needed.

SUMMARY OF THE INVENTION

A dual purpose ladder attachment which can be used as a human support platform with hand rails or alternatively as a scaffold jack. The invention comprises parallel, L-shaped support members, the ends of which are joined to the side rails of the ladder by special brackets, described in greater detail below. All of the brackets include U-shaped channels that are sized and shaped to fit over the side rails of the ladder. The wall of the U-shaped channel that engages the inward surface of the ladder rail has semi-circular recesses on its upper and lower edges, each recess being sized for fitting partially around a ladder rung.

Each L-shaped support member is constructed of a first beam and a second beam pivotally connected at one end to each other. The opposite beam ends are engaged in the brackets to form a support member that is engaged on each side of the ladder.

When the invention is used in the platform position, an additional platform support bar is connected between the L-shaped support members at a level equal to the height of a supporting ladder rung such that a rigid platform suitable for a person to stand on can be mounted between the additional platform support bar and a selected ladder rung, in a plane parallel to the ground.

In the human support platform position each L-shaped member is connected to the ladder by placing one bracket on the side rail of the ladder in engaging relation with a predetermined ladder rung such that the first beam of the L-shaped member is vertically oriented projecting upwardly from the bracket. The bracket at the other end of the L-shaped member is placed over the same side rail of the ladder above the first bracket in engaging relation with another ladder rung such that the second beam of the L-shaped member is maintained in a perpendicular position relative to the first beam to which it is attached. The same procedure is followed for the L-shaped member installed on the other side rail of the ladder.

In order to change the ladder attachment from a human support platform position to a scaffold jack position, each L-shaped member is simply inverted and placed on the opposite side rail of the ladder such that the L-shaped member now projects inwardly on the underside of the ladder. After each L-shaped member is inverted, the second beam of each L-shaped member must be rotated 180° about the connecting point of the first beam to the second beam in order to engage with the side rail of the ladder.

It is the primary object of this invention to provide a lightweight, convertible ladder attachment which can be used either as a human support platform with hand rails or a scaffold jack.

It is another object of this invention to provide a lightweight, convertible ladder attachment which can be folded for easy transportation and storage.

In accordance with these and other objects which will be apparent hereinafter, the instant invention will now be described with particular reference to the accompanying drawings.

BRIEF DESCRIPTION OF THE DRAWINGS

FIG. 1 is a perspective view of the invention in use as a human support platform.

FIG. 2 is a perspective view of the invention being used in the human support platform position attached to a ladder.

FIG. 3 represents a side elevational view of the invention in a human support platform position attached to a ladder.

FIG. 4 represents a detailed, side elevational, fragmentary view of a first the bracket in the human support platform position.

FIG. 5 represents a detailed, side elevational, fragmentary view of a second bracket in the human body support platform position.

DESCRIPTION OF THE PREFERRED EMBODIMENT

Figure 6:
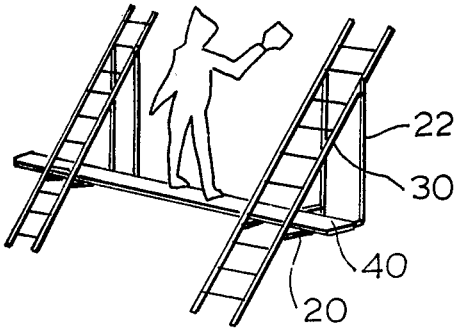
FIG. 6 represents a perspective view of the invention being used as a scaffold support.

Referring to FIGS. 1, 2, and 3 the ladder attachment 2 is shown in the human support platform position. The ladder attachment 2 has two L-shaped members 12 and 14, each one having a respective short strut member 16 and 20 and a respective long strut member 18 and 22. The short strut member 16 is pivotally connected to the long strut member 18 and the short strut member 20 is pivotally connected to the long strut member 22.

Each end of the L-shaped members 12 and 14 is fixed to a respective support bracket 4, 6, 8, or 10. As shown in FIG. 4, the brackets 4 and 6 which are attached to a respective short strut member 16 and 20 by threaded fasteners, are aligned such that the short strut members 16 and 20 are held in a position parallel to the ground.

The brackets 8 and 10 which are attached to a respective long strut member 18 and 22 are constructed to hold the long strut members 18 and 22 in a position perpendicular to the ground, as shown in FIG. 5. Brackets 4 and 6 are different then brackets 8 and 10 in that different angles between the strut and rail channels are provided.

Each bracket 4, 6, 8, and 10 has a channel portion which slides over a respective side rail 30 and 32 of a ladder with the innermost side of the bracket 4, 6, 8, and 10 having a semi-circular shaped recession along its top edge and bottom edge. The semi-circular recession fits against a portion of the ladder rung 28 holding the bracket 4, 6, 8, and 10 in place and providing support for the device 2.

When using the device 2 as a stand-up safety ladder platform from the front side of the ladder 34, it is preferred that the support brackets 4 and 6 supported by ladder rung 28*a* are properly spaced from support brackets 8 and 10 which are supported by ladder rung 28*c* so that the short strut members 16 and 20 are at right angles with respect to the long strut members 18 and 22 at their respective connecting points.

A platform support member 24 is detachably connected at each of its ends to a respective support member 12 and 14 so that the platform support member 24 is perpendicular to the long strut members 18 and 22. The platform support member 24 is installed at a vertical height equal to the vertical height of the ladder rung 28*b*, which allows the platform 26 to lie in a plane parallel to the ground when inserted over the platform support member 24 and the ladder rung 28*b*. Once the platform 26 is installed, the device 2 is ready for use and the short strut members 16 and 20 may be utilized as hand rails for additional balance for the occupant of the platform as illustrated in FIG. 1.

Figure 7:
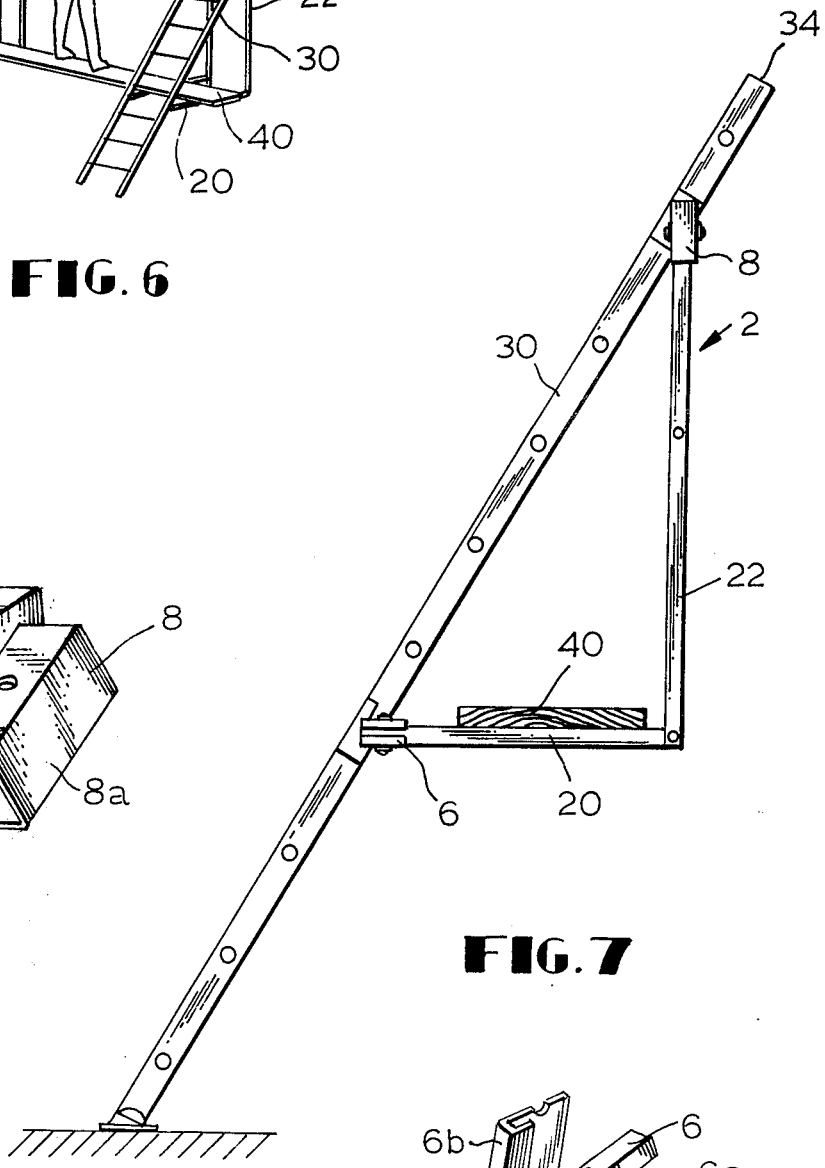
FIG. 7 is a side elevational view of the invention being used as a scaffold support attached to a ladder.

Referring to FIG. 7, a second embodiment of the device 2 is illustrated in the scaffold jack position, wherein the ladder attachment projects from the underside of the ladder 34. In the scaffold jack position, the support brackets 4 and 6, which are attached to the respective short strut members 16 and 20, are supported by ladder rung 28*c*, while the support brackets 8 and 10, which are attached to the respective long strut members 18 and 22, are supported by ladder rung 28*a*, such that the short strut members 16 and 20 support a scaffold board 40 along their upper edges. When using the invention 2 for a scaffold jack, at least two ladders 34 and two ladder attachments 2 are required as illustrated in FIG. 6.

The preferred construction material for the ladder platform and scaffold jack device 2 is aluminum. Thus, the device 2 being lightweight and foldable can be easily stored when not being used.

The ladder attachment 2 can be used in the position shown in FIG. 2 when the work to be performed is in the near vicinity of the ladder. However, when it becomes necessary to use the ladder attachment 2 as a scaffold jack as shown in FIG. 6, the ladder attachment 2 must be repositioned.

In order to change the ladder attachment from the human support platform position of FIG. 2, to the scaffold jack position of FIG. 6, each L-shaped member 12 and 14 comprised of a short strut 16 or 20 and a long strut 18 or 22 is merely inverted and placed on the opposite side rail of the ladder 34. The procedure would be as follows: The support brackets 8 and 10 would be rotated 180° about an axis parallel to the short struts 16 and 20 such that the long struts 18 and 22 project downwardly behind the underside of the ladder 34. The bracket 8 is placed onto side rail 32 and locked over ring 28*a*. The bracket 10 is placed over side rail 30 and locked over rung 28*a*. The short struts 16 and 20 are then rotated 180° about the pivotal connections with the respective long struts 18 and 22 so that they may be connected to the ladder 34 near the ladder rung 28*c*. The bracket 6 is placed onto the side rail 32 and locked over the ladder rung 28*c* and the bracket 4 is placed onto the side rail 30 and locked over the ladder rung 28*c*.

Figure 8:
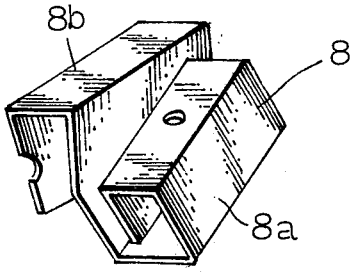
FIG. 8 is a perspective view of one type of support bracket of the invention.
Figure 9:
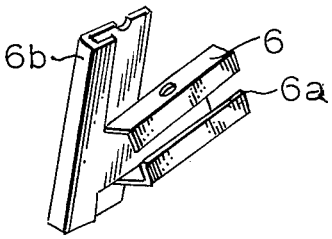
FIG. 9 is a perspective view of another type of support bracket of the invention.

Referring to FIGS. 8 and 9, the brackets 8 and 10 and the brackets 4 and 6 are designed to provide the proper angular relationships between the L-shaped members and the side rails of the ladder to make the ladder attachment functional. For example, the bracket 8 has the portion 8*a* which holds the long strut 22 within the bracket 8 by way of a nut and bolt as shown in FIG. 5. The other portion 8*b* of the bracket is U-shaped in order that it may be fitted over the side rail of a ladder. The portion 8*b* also has semi-circular recesses on the upper and lower edges of the surface which rests along the inward face of the side rail in order to engage with the ladder rung. The angular relationship between the portion 8*a* and the portion 8*b* is such as to hold the long strut 22 in a substantially vertical position. The bracket 10 is identical to the bracket 8 except it is designed to always be placed on the opposite side rail of the ladder that the bracket 8 is placed on.

The bracket 6 has a portion 6*a* which holds the short strut 20 within the bracket 6 by way of a nut and bolt as shown in FIG. 4. The other portion 6*b* of the bracket is U-shaped in order that it may be fitted over the side rail of a ladder. The portion 6*b* also has semi-circular recesses on the upper and lower edges of the surface which rests along the inward face of the side rail in order to engage with the ladder rung. The angular relationship between the portion 6*a* and 6*b* is such as to hold the short strut 22 in a substantially horizontal position. The bracket 4 is identical to the bracket 6 except it is designed to always be placed on the opposite side rail of the ladder that the bracket 4 is placed on.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A dual purpose ladder attachment convertable from a human support platform position to a scaffold position simply by inverting the device, comprising:

a pair of L-shaped support members;

each said support member having a first strut member and a second strut member, said first strut member having one end pivotally connected to one end of said second strut member;

one end of each said first strut member connected to a respective first-type bracket;

one end of each said second strut member connected to a respective second-type bracket;

said first-type and second-type brackets being slidably engageable with a side rail of the ladder and having a portion thereof slotted and sized to partially encompass a preselected rung of the ladder to hold said first-type and said second-type brackets in place a platform; and a platform support member having each end demountably attached to a respective support member such that said platform can be supported by said platform support member and a ladder rung.

* * * * *